US009033600B2

(12) United States Patent
Nakai et al.

(10) Patent No.: US 9,033,600 B2
(45) Date of Patent: May 19, 2015

(54) JAM-FREE PRINTER

(75) Inventors: Toshihiko Nakai, Saitama (JP); Takeshi Yamazaki, Nagano (JP); Hirotaka Kamiya, Nagano (JP)

(73) Assignee: CITIZEN HOLDINGS CO., LTD., Tokyo (JP)

( * ) Notice: Subject to any disclaimer, the term of this patent is extended or adjusted under 35 U.S.C. 154(b) by 943 days.

(21) Appl. No.: 12/129,128

(22) Filed: May 29, 2008

(65) Prior Publication Data

US 2009/0297246 A1 Dec. 3, 2009

(51) Int. Cl.
*B41J 11/00* (2006.01)
*B41J 13/00* (2006.01)
*B41J 11/66* (2006.01)

(52) U.S. Cl.
CPC ..... *B41J 13/0027* (2013.01); *B41J 11/663* (2013.01); *B41J 13/0045* (2013.01)

(58) Field of Classification Search
USPC ..... 400/621
See application file for complete search history.

(56) References Cited

U.S. PATENT DOCUMENTS

| | | | | |
|---|---|---|---|---|
| 4,457,617 | A * | 7/1984 | Tolmie, Jr. | 399/17 |
| 4,675,698 | A * | 6/1987 | Tsutsumi | 347/217 |
| 5,636,926 | A * | 6/1997 | Yamaguchi | 400/120.02 |
| 5,663,804 | A * | 9/1997 | Kataoka et al. | 358/304 |
| 5,725,318 | A * | 3/1998 | Yamaguchi et al. | 400/120.02 |
| 5,904,429 | A * | 5/1999 | Goodwin et al. | 400/693 |
| 5,967,675 | A * | 10/1999 | Hastings et al. | 400/61 |
| 6,056,460 | A * | 5/2000 | Suzuki | 400/621 |
| 7,503,712 | B2 * | 3/2009 | Fukano | 400/76 |
| 2005/0232031 | A1 * | 10/2005 | Fukano | 365/189.05 |
| 2006/0165461 | A1 * | 7/2006 | Vandermeulen et al. | 400/208 |
| 2006/0239744 | A1 * | 10/2006 | Hideaki | 400/249 |
| 2007/0008589 | A1 * | 1/2007 | Ushio et al. | 358/304 |

FOREIGN PATENT DOCUMENTS

| | | | |
|---|---|---|---|
| JP | 64-051963 | A | 2/1989 |
| JP | 01-135681 | A | 5/1989 |
| JP | 2-243372 | A | 9/1990 |
| JP | 02-249673 | A | 10/1990 |
| JP | 08-067041 | A | 3/1996 |
| JP | 11-105315 | A | 4/1999 |
| JP | 2000-25316 | A | 1/2000 |
| JP | 2000-025316 | A | 1/2000 |
| JP | 2005-515092 | A | 5/2005 |
| JP | 2005-199582 | A | 7/2005 |
| JP | 2005-215233 | A | 8/2005 |
| JP | 2006-123279 | A | 5/2006 |

OTHER PUBLICATIONS

Notification of Reasons for Refusal dated Sep. 11, 2008, issued in corresponding Japanese Patent Application No. 2006-324616.
Notification of Reasons for Refusal dated Dec. 16, 2008, issued in corresponding Japanese Patent Application No. 2006-324616.
Notification of Reasons for Refusal dated Jun. 18, 2010, issued in corresponding Japanese Patent Application No. 2006-324616.

* cited by examiner

*Primary Examiner* — Michael G Lee
*Assistant Examiner* — David Tardif
(74) *Attorney, Agent, or Firm* — Westerman, Hattori, Daniels & Adrian, LLP

(57) ABSTRACT

A printer that prints on a rolled recording paper, cuts the printed recording paper to a predetermined length, and ejects the cut recording paper. The printer includes storage 30*b* that stores a print status wherein, at the time of powering on, the printer references a previous print status based on the print status stored in the storage and, if the previous print operation is not completed, ejects the recording paper for a maximum print length and cuts the ejected recording paper.

2 Claims, 8 Drawing Sheets

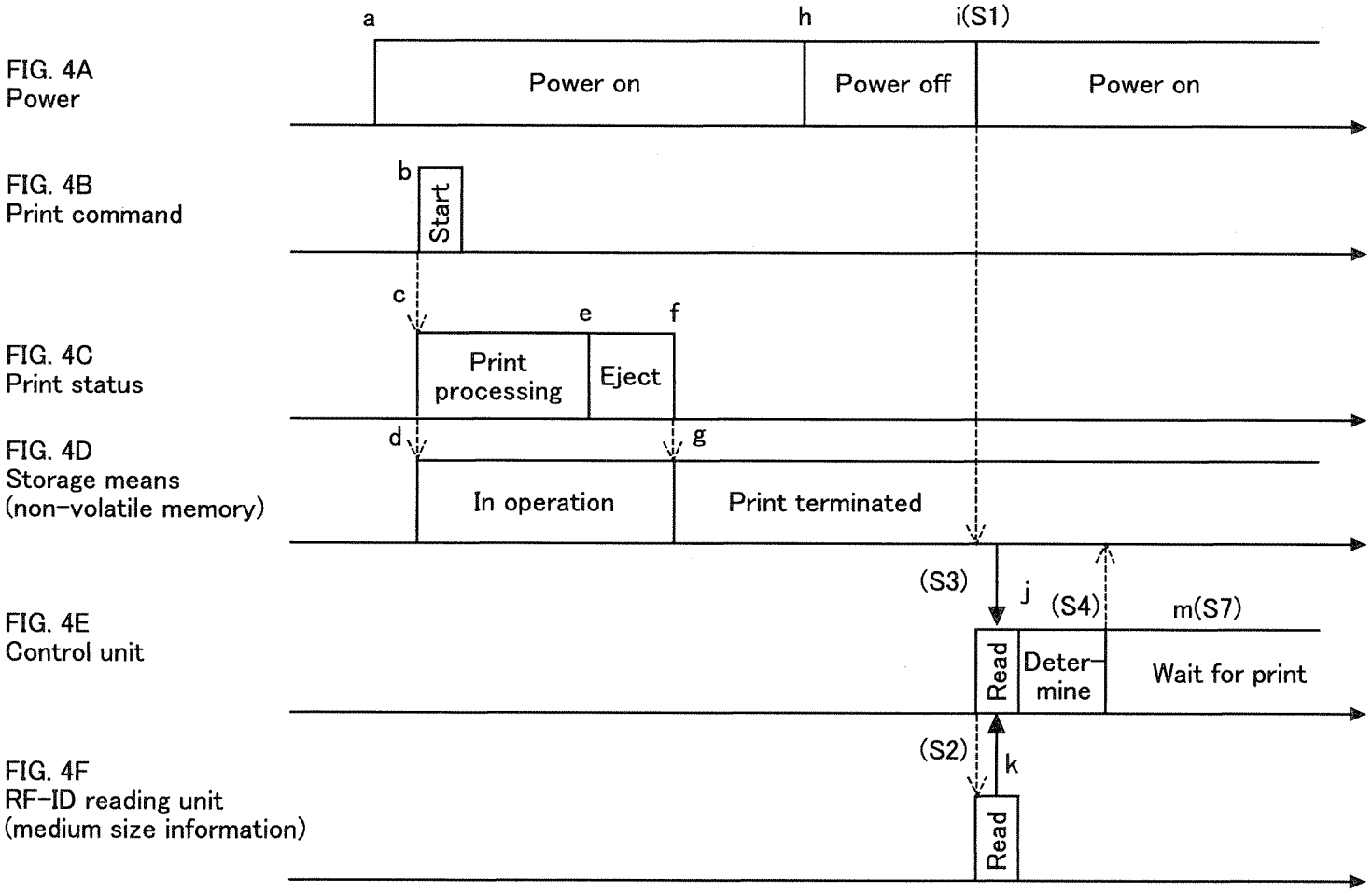
FIG. 4A Power
FIG. 4B Print command
FIG. 4C Print status
FIG. 4D Storage means (non-volatile memory)
FIG. 4E Control unit
FIG. 4F RF-ID reading unit (medium size information)

Power

Print command

Print status

Storage means
(non-volatile memory)

Control unit

RF-ID reading unit
(medium size information)

JAM-FREE PRINTER

FIELD OF THE INVENTION

The present invention relates to a printer that prints different colors on the same paper by reciprocating a rolled recording paper under the head to repeat printing on a recording paper multiple times.

RELATED ART

A multi-color printer for use in color printing uses three primary colors (yellow, magenta, and cyan) or four colors including black. One of such multi-color printers that are known is a printer that prints different colors on the same paper by repeating printing multiple times with a rolled recording paper reciprocating (For example, see Patent Document 1).

To print on a recording paper, fed from the feed roller, with the use of the head, the printer disclosed in Patent Document 1 stores the recording paper, on which one color is printed with the use of one color head, in the recording paper storage unit. To print the next color, the printer rolls back the recording paper stored in this recording paper storage unit, passes the recording paper again under the next color head to print the next color on the printed paper, and stores the printed recording paper in the recording paper storage unit. In this way, the printer stores the recording paper into, and takes it out from, the recording paper storage unit each time the printer prints a color.

In the usual print operation, the sensors check the state of the ink ribbon and the recording paper and, when an abnormal condition is detected, the print operation is stopped and an error is displayed to notify the maintenance engineer that an error recovery action is necessary. The maintenance engineer takes a necessary recovery action according to the content of the error display and restores the printer again to the printable condition.

On the other hand, when the power is shut down during the print operation because of a power failure, the print operation stops halfway during the print operation. When the power is turned on again after the print operation was stopped, the printer performs the initialization operation to restore itself to the printable condition. The problem is that, if the power shutdown occurs during the print operation regardless of whether or not the print operation is being performed, the recording paper is not ejected but is left in the printer. Another problem is that the printer does not have information on whether or not the halfway-printed recording paper is left in the printer.

[Patent Document 1] Japanese Patent Laid-Open Publication No. Hei 8-67041

When the power is shut down during the print operation on the printer described above and the power is turned on again, the printer enters the printable state with the halfway-printed paper left in the printer. An attempt to print in this state causes the printer, which assumes that no image is printed on the print surface of the paper, to print on the halfway-printed print surface.

FIG. 8 is a diagram showing the print status of a conventional printer. FIG. 8A shows the status in which printing is stopped halfway, and FIGS. 8B and 8C show the print status after the power is turned on again. Referring to FIG. 8, a recording paper 10 is rolled on a rolled paper holder 2, and ink of a film-like ink ribbon held on an ink ribbon cassette 4 is adhered on a recording paper 10 to print on it, unrolled from the rolled paper holder 2, with the use of a head 3.

If printing is stopped halfway on this printer because of a power failure, the recording paper 10 being printed is not ejected but is left in the printer with a print area 10*a*, which was printed in the previous print operation, still printed on the recording surface of the recording paper 10 (FIG. 8A).

When the power is turned on again, the ink of the ink ribbon is adhered on a recording paper 10 to print on it by the head 3 while rolling the recording paper 10 back onto the rolled paper holder 2 (FIG. 8B). This printing causes a current print area 10*b* to overlay on the previous print area 10*a* on the recording surface of the recording paper 10. Such a multiply-printed print material is not acceptable commercially and should be avoided.

In addition, when printing is performed in the same print area multiple times, the ribbon used for the previous print operation may cause a ribbon peel error for the ribbon used for the current print operation because the ribbons overlap in the same print area. So, after printing is stopped halfway because of a power failure and before the power is turned on again for restarting printing, the maintenance engineer must check the paper status of the printer and remove a halfway-printed paper if any.

SUMMARY OF THE INVENTION

Therefore, it is an object of the present invention to solve the problems described above. More particularly, an object of the present invention is to remove a halfway-printed recording paper before printing is restarted from the status in which the halfway-printed paper is left in a printer that reciprocates a rolled recording paper to repeatedly print thereon.

It is another object of the present invention to automatically set the length of a recording paper to be removed according to the size of a print area to be printed on the recording paper.

In one mode of the present invention, there is provided a printer that prints on a rolled recording paper using an ink ribbon, cuts the printed recording paper to a predetermined length, and ejects the cut recording paper wherein, in cutting and removing the recording paper when printing is restarted in a status in which previous printing is not completed, a length of the recording paper that is cut is determined according to an effective length of the ink ribbon. By setting the length of the recording paper to be cut according to the effective length of the ink ribbon, the length of the recording paper to be removed is automatically set according to the size of a print area printed on the recording paper.

The ink ribbon used for the printing is selectable from ink ribbons having different effective lengths, and the effective length of the ink ribbon is a length required for one print operation in which a selected and mounted ink ribbon is used. According to this configuration, the length of the recording paper that is removed can be determined according to the length corresponding to the length printed by the ink ribbon used in one print operation.

In another mode of the present invention, when the power is turned on to start printing, the printer determines if the print operation was halfway through when the previous print operation was stopped. If the print operation was halfway through, the maximum print length, which is set in the printer as the print condition, is acquired and the rolled recording paper is fed for the maximum print length and is cut.

When a halfway printed recording paper is left in the printer, one of the methods for avoiding an overlap between the previous print area and the current print area is to feed the recording paper for a predetermined length when the power is turned on again so that the overlap in the print area can be avoided.

Meanwhile, the sizes of print areas printed by the printer include various sizes such as the L-size, 2L-size, or a long size such as A5. On the other hand, the printer is not always compatible with the print sizes of various printed materials (hereinafter, a printed material is called a medium, and the print size of a printed material is called a medium size). That is, the printer prints, not all medium sizes, but normally only one type of medium size. This is because the size of a medium to be printed depends on the ink ribbon used for the printing. To print different medium sizes on the printer, the ink ribbon must be exchanged for the one corresponding to the medium size.

So, to avoid an overlap between the print areas, the following two are necessary: (a) Check whether or not the overlap between the print areas must be avoided and (b) Feed the paper for a right length to remove the exact amount of overlap between the print areas if it is necessary to avoid them. Because the overlap cannot be avoided if the amount of paper feed is too small and because the recording paper must be cut and removed wastefully if the amount of paper feed is too large, the paper must be fed for the length corresponding to the maximum medium size printable by the printer.

To solve this problem, a printer according to the present invention checks if the printing was halfway through when the printer stopped immediately before and, thereby, confirms if there is a need to avoid an overlap between the print areas. If the printing was halfway through, the printer acquires the maximum print length that is set in the printer as the print condition, feeds the rolled paper for the maximum print length, and cuts the fed recording paper to remove the halfway-printed recording paper. In addition, the printer automatically sets the length of the recording paper to be removed according to the size of the print area printed on the recording paper.

A printer of the present invention, which prints on a rolled recording paper, cuts the printed recording paper to a predetermined length, and ejects the cut recording paper, comprises storage means that stores a print status wherein, at power-on time, the printer references the print status of a previous print operation based on the print status stored in the storage means and, when the previous print operation is not completed, ejects the recording paper for a maximum print length and cuts the ejected recording paper.

A printer of the present invention, which has the configuration for implementing the functions described above, comprises a rolled paper drive unit that feeds a rolled recording paper; a recording paper cutting unit that cuts the rolled recording paper on an ejection path; a print status storage unit that constantly updates a print status and stores a latest print status; and a control unit that controls at least the rolled paper drive unit and the recording paper cutting unit.

When the printer is switched from a print stopped state to a print state, the control unit reads the print status stored in the print status storage unit. If the print status that is read indicates that the printer is in print operation, the control unit causes the rolled paper drive unit to feed a recording paper on the ejection path for a maximum print length and to eject the fed recording paper and causes the recording paper cutting unit to cut the recording paper ejected by the rolled paper drive unit.

Medium size information corresponding to the print area size can be recorded on a recording medium that is an RF-ID tag. The control unit of the printer reads this medium size information, calculates the length corresponding to the maximum print length to be fed based on the medium size information that is read, and controls an ejection operation of the rolled paper drive unit based on the length corresponding to the calculated maximum print length.

The control unit of the printer of the present invention reads the print status, stored in the print status storage unit, in response to the power-on signal and, if the print status that is read indicates that the printer is in print operation, instructs the rolled paper drive unit to eject the recording paper with the maximum print length, which is acquired based on the medium size information read by the RF-ID reading unit, as a recording paper ejection amount, and instructs the recording paper cutting unit to cut the ejected recording paper.

The RF-ID tag, which is a recording medium in which the medium size information is stored, can be provided on an ink ribbon cassette supporting an ink ribbon. The printer of the present invention further comprises an RF-ID reading unit that reads medium size information from the RF-ID tag provided on the ink ribbon that is set on the ink ribbon cassette.

The size information on a medium, on which an image is printed by the ink ribbon, is recorded in the RF-ID tag and, in addition, the ink ribbon is set on the ink ribbon cassette when used. Therefore, when the ink ribbon cassette is mounted on the printer, the RF-ID reading unit can read an RF-ID tag provided on the ink ribbon and acquire the size information on the medium on which an image is printed by the ink ribbon.

According to the printer of the present invention, a halfway-printed recording paper, if left in the printer, can be removed when printing is restarted.

In addition, when removing a halfway-printed recording paper, the length of a recording paper to be removed can be automatically set according to the size of a print area to be printed on the recording paper.

BRIEF DESCRIPTION OF THE DRAWINGS

FIG. 4 is a timing diagram showing how the printer of the present invention removes a halfway-printed recording paper.

DETAILED DESCRIPTION OF PREFERRED EMBODIMENT

An embodiment of a printer according to the present invention will be described with reference to FIG. 1 to FIG. 7.

Figure 1:
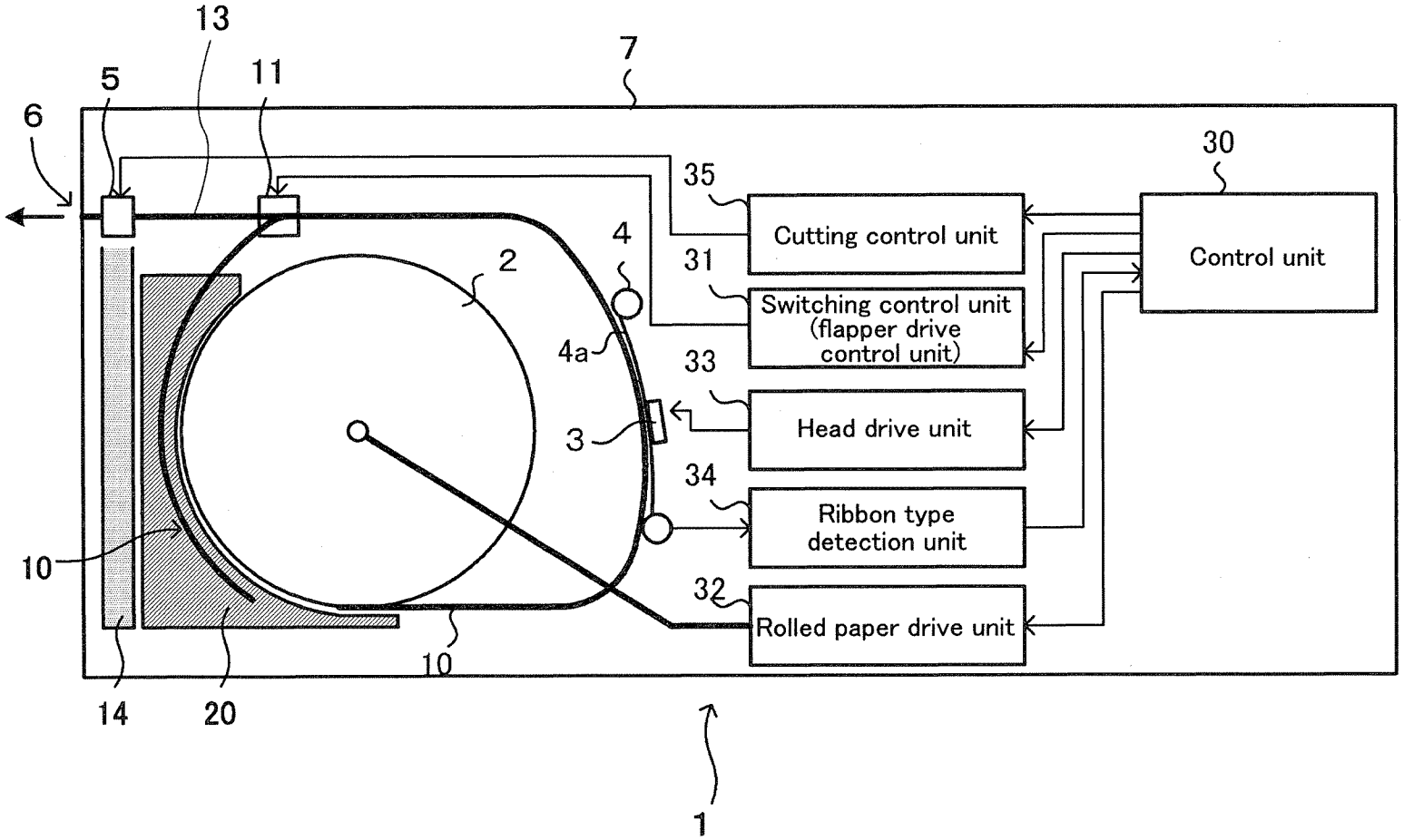
FIG. 1 is a diagram showing the general configuration of a printer of the present invention.

FIG. 1 is a diagram showing the general configuration of the printer of the present invention. Note that, in FIG. 1, only the components of a printer 1 required for the description of the present invention are shown and other components are omitted.

The printer 1 holds a rolled recording paper 10 on a rolled paper holder 2 and prints on the recording surface of the recording paper 10 unrolled from the rolled paper holder 2. To hold the rolled recording paper 10 on the rolled paper holder 2, the central axis of the rolled recording paper 10 is supported rotatably by the rolled paper holder 2. This structure allows the recording paper 10 to be stored rotatably on the rolled paper holder 2.

Printing is performed, for example, by recording ink in predetermined positions using a head 3 with an ink ribbon 4*a*, held by an ink ribbon cassette 4, abutting on the recording surface of the recording paper 10. To perform multi-color printing such as color printing during this printing, multiple ink parts, such as yellow, magenta, and cyan corresponding to the colors to be printed, are prepared on the ink ribbon 4*a* sequentially along the winding direction of the ink ribbon 4*a*, and the operation in which the ink part passes under the head 3 is repeated for each color while winding the ink ribbon 4*a*. At this time, the recording paper 10 is reciprocated to overlay the colors in the same print area on the recording paper 10. The recording paper 10 can be reciprocated by changing the rotational direction of the rolled paper holder 2 to repeatedly unroll and roll the rolled paper.

This operation causes the recording paper 10 to be reciprocated under the head 3 and repeats printing in the same print area on the recording paper 10 multiple times.

The ink ribbon has the color parts (yellow, magenta, and cyan) as well as the overcoat layer that covers the print surface, on which all colors are printed, for protecting it.

The recording paper 10, which has been printed, passes under the head 3, passes through an ejection path 13, and is ejected externally of the printer through an ejection slot 6 provided on a housing 7 of the printer 1.

For printing each color, the recording paper 10 once passes under the head 3 and is fed for the length corresponding to the print length and, after that, is reversed and rolled. The head 3 prints an image when the recording paper 10 is rolled. At this time, the recording paper 10 that has passed under the head 3 must be set aside temporarily within the printer 1.

In the configuration of the printer 1 according to the present invention shown in FIG. 1, the printer 1 uses the peripheral part of the rolled paper holder 2 as a recording paper storage unit 12 and uses that part as a storage space 20 where the recording paper is temporarily set aside. In FIG. 1, the recording paper storage unit 12 is indicated by the shaded part. This recording paper storage unit 12 is created using a space in the peripheral part of the rolled paper holder 2, with the storage space formed by a gap between at least a part of the whole periphery and the inside wall of the printer. Normally, the peripheral part of the rolled paper holder has a space for storing the rolled paper and for unrolling and feeding the unrolled paper. Because the diameter of the periphery of the rolled paper holder is normally large enough to have a margin so that the peripheral part of the rolled paper does not contact the inside wall of the printer even when the diameter of this rolled paper is the maximum, an extra space is provided in the peripheral part of the rolled paper holder. After the rolled paper on the rolled paper holder is unrolled, at least the space where the rolled paper was rolled becomes empty.

So, the peripheral part of the rolled paper has a space sufficient for storing at least a recording paper that is unrolled from the rolled paper and fed for printing.

A switching guide unit 11 is provided in the downstream of the head 3 and in the upstream of the recording paper storage unit 12 and the ejection path 13. This switching guide unit 11 switches the leading edge of the recording paper 10, which has passed under the head 3, to the recording paper storage unit 12 or to the ejection path 13 for guiding the recording paper 10 to the desired switching direction. This switching guide unit 11 may be configured, for example, by a flapper plate.

The printer 1 also has a recording paper cutting unit 5 on the ejection path 13 and immediately before the ejection slot 6. The recording paper cutting unit 5 cuts the recording paper 10, which has passed through the ejection path 13 and which is sent out externally from the ejection slot 6, at the position before the ejection slot 6. With the recording paper 10 stuck out from the ejection slot 6, the recording paper cutting unit 5 cuts the recording paper 10 at a predetermined position of its trailing part to allow the recording paper 10, which has been cut, to be taken out from the ejection slot 6. In addition, before the recording paper 10 is stuck out from the ejection slot 6, the recording paper cutting unit 5 can cut the recording paper 10 at multiple positions to cut it into small chips.

Below the recording paper cutting unit 5 is provided a chip storage unit 14 that stores the chips generated by the recording paper cutting unit 5. Storing the chips in the chip storage unit 14 prevents the chips from being leaked from the printer 1.

In the configuration shown in FIG. 1, the chip storage unit 14, provided at a position adjacent to the rolled paper holder 2, establishes the other border of the recording paper storage unit 12 formed by the periphery of the rolled paper holder 2 described above. Although an example is shown in FIG. 1 in which a part of the border of the recording paper storage unit 12 is formed by the wall surface of the chip storage unit 14, the surface that, together with the periphery of the rolled paper holder 2, forms the border of the recording paper storage unit 12 is not limited to the wall surface of this chip storage unit 14. The surface of any component arranged in the position opposed to the periphery of the rolled paper holder 2 in the printer 1 may also be used.

The printer 1 comprises drive units (rolled paper drive unit 32, head drive unit 33) that drive the components described above, control units (control unit 30, switching control unit 31, cutting control unit 35) that perform the control operation, and an RF-ID reading unit 34.

The rolled paper drive unit 32 drives the rolled paper stored in the rolled paper holder 2. The rolled paper drive unit 32, which can reverse the drive direction, feeds the recording paper 10 by rotating the rolled paper in the direction in which the rolled paper is unrolled, and restores the fed recording paper 10 by reversing the drive direction to rotate the rolled paper in the direction in which the rolled paper is rolled. The printer of the present invention prints on the recording paper 10 when the fed recording paper 10 is restored.

The head drive unit 33 drives the head based on image data and prints predetermined images or characters on the recording paper 10. The head may use any mechanism according to various print methods of the printers such as a sublimatic printer or a thermal-transfer printer. The printer 1 further comprises an ink ribbon drive unit (not shown in FIG. 1) that drives the ink ribbon 4 and, in synchronization with the head drive operation, causes the ink ribbon 4 to move with the head for printing on the recording paper 10.

When printing with the ink ribbon, the length of a print on the recording paper 10 depends on the length of the colors of the ink ribbon. For example, when an image corresponding to the L-size or 2L-size picture is printed, the ink ribbon has the size corresponding to the L-size or 2L-size and the image is printed by moving the ink ribbon for the horizontal length.

So, the driving amount of the rolled paper drive unit 32 and the ink ribbon drive unit (not shown) must be determined according to the type of the ink ribbon 4*a* mounted on the printer 1. For this reason, a chip memory element (not shown) such as an RF-ID tag, in which type data on this ink ribbon 4*a* is recorded, is mounted on the ink ribbon cassette 4 so that the RF-ID reading unit 34 can detect this memory element.

The type data on the ink ribbon 4*a* has information on the size of a printed material to be printed on the recording paper. In the description below, this printed material is a called a medium, and the print size of a printed material is called a medium size. The size of a medium that is printed depends on the ink ribbon used for printing. To print media of different sizes, the ink ribbon for the one corresponding to the medium size should be exchanged.

The printer of the present invention performs the print processing using the medium size information recorded in a chip memory element such as an RF-ID tag. In addition, when power-on time removing a recording paper which has stopped on a half way, the printer of the present invention calculates the maximum print length based on the medium size information written in this ID, feeds the recording paper 10 for the maximum print length, and cuts the fed recording paper to prevent multiple images from being printed in the same position. The configuration and the operation will be described later in detail.

The control unit 30 acquires the ink ribbon type from the detected data and, based on the acquired ink ribbon type, controls the drive amount of the rolled paper drive unit 32 or the driven amount of the ink ribbon drive unit (not shown).

The switching control unit 31 controls a switching guide unit 11 to switch the direction, into which the leading edge of the recording paper 10 should be sent, to one of two sides: recording paper storage unit 12 side or ejection path 13 side. This switching is controlled as follows. When the print operation is being performed, the leading edge of the recording paper 10 is switched to the recording paper storage unit 12 side in order to temporarily set aside the recording paper 10 therein; when the print operation is terminated, the leading edge of the recording paper 10 is switched to the ejection path 13 side in order to eject the recording paper 10 from the ejection slot 6.

The recording paper cutting control unit 35 controls the recording paper cutting unit 5 to cause it to cut the recording paper 10 at its trailing edge of the recorded part into a sheet of recording paper when the recording paper 10, conveyed along the ejection path 13, is ejected externally of the ejection slot 6 or to cut the recording paper 10 into small pieces for discarding purposes.

Figure 2:
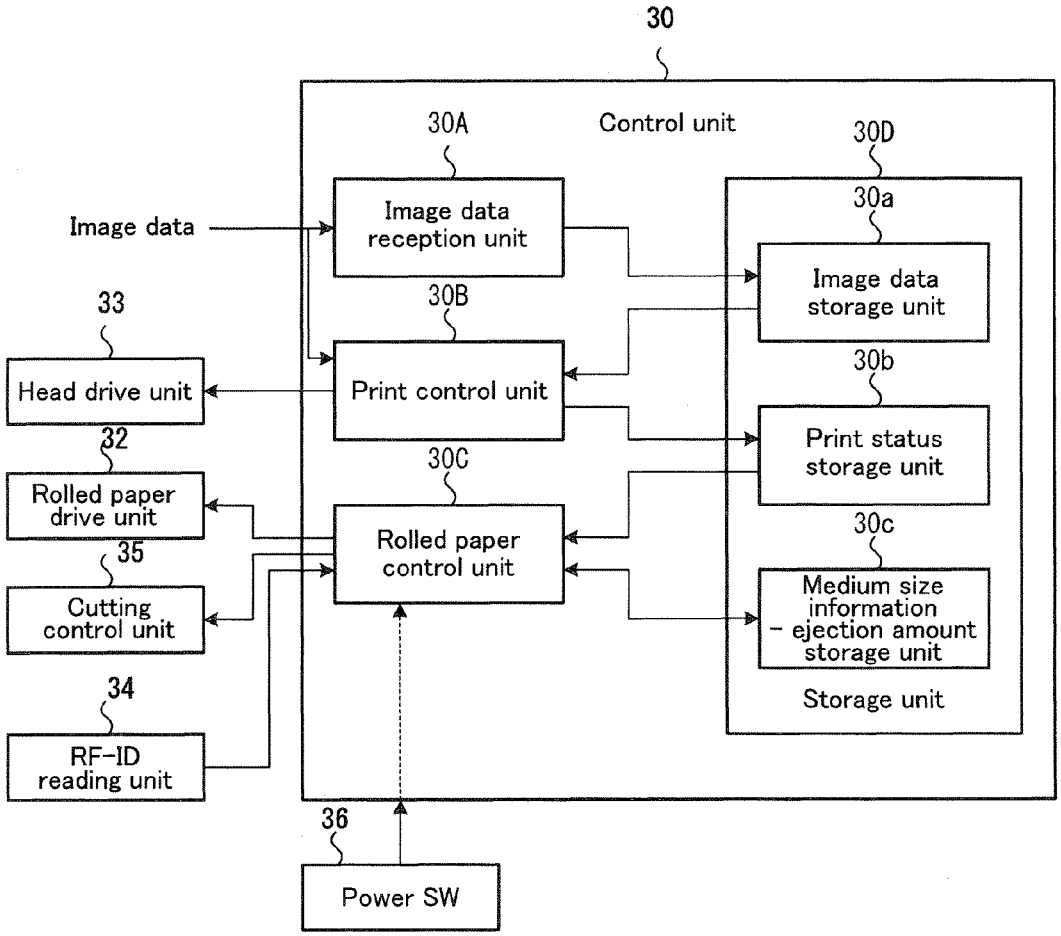
FIG. 2 is a functional block diagram showing the functions of a control unit of a printer of the present invention.

FIG. 2 is a functional block diagram showing the functions of the control unit 30 of the printer 1 according to the present invention. In the description below, the functional blocks are shown to describe the functions of the control unit 30. The configuration of those functions includes the CPU, the memory in which processing programs and processing data are stored, and the processing units that perform program processing for performing data calculation. This configuration may be a software configuration in which programs are executed under instructions from the CPU or a hardware configuration in which the functions are implemented by DSPs and logic circuits.

The control unit 30 comprises an image data reception unit 30A that receives image data to be printed, a print control unit 30B that controls the printing of image data by controlling the head drive unit 33, a rolled paper control unit 30C that controls the driving of the rolled paper drive unit 32 and the cutting control unit 35, and a storage unit 30D. The storage unit 30D comprises an image data storage unit 30*a* that stores image data received by the image data reception unit 30A, a print status storage unit 30*b* that obtains print status data from the print control unit 30B and stores it, and a medium size information—ejection amount storage unit 30*c* that stores the relation between the medium size information and the ejection amount of recording paper. The print status storage unit 30*b* and the medium size information—ejection amount storage unit 30*c* are configured by a non-volatile memory to retain the storage contents even when the power is turned off and, after the power is turned on again, to enable the storage contents to be supplied to the rolled paper control unit 30C.

In addition to the storage units 30*a*-30*c* described above, the storage unit 30D further comprises a storage unit, not shown, in which programs that control the print processing by the print control unit 30B and programs that control the whole printer are stored. The description of this storage unit is omitted here.

Figure 3:
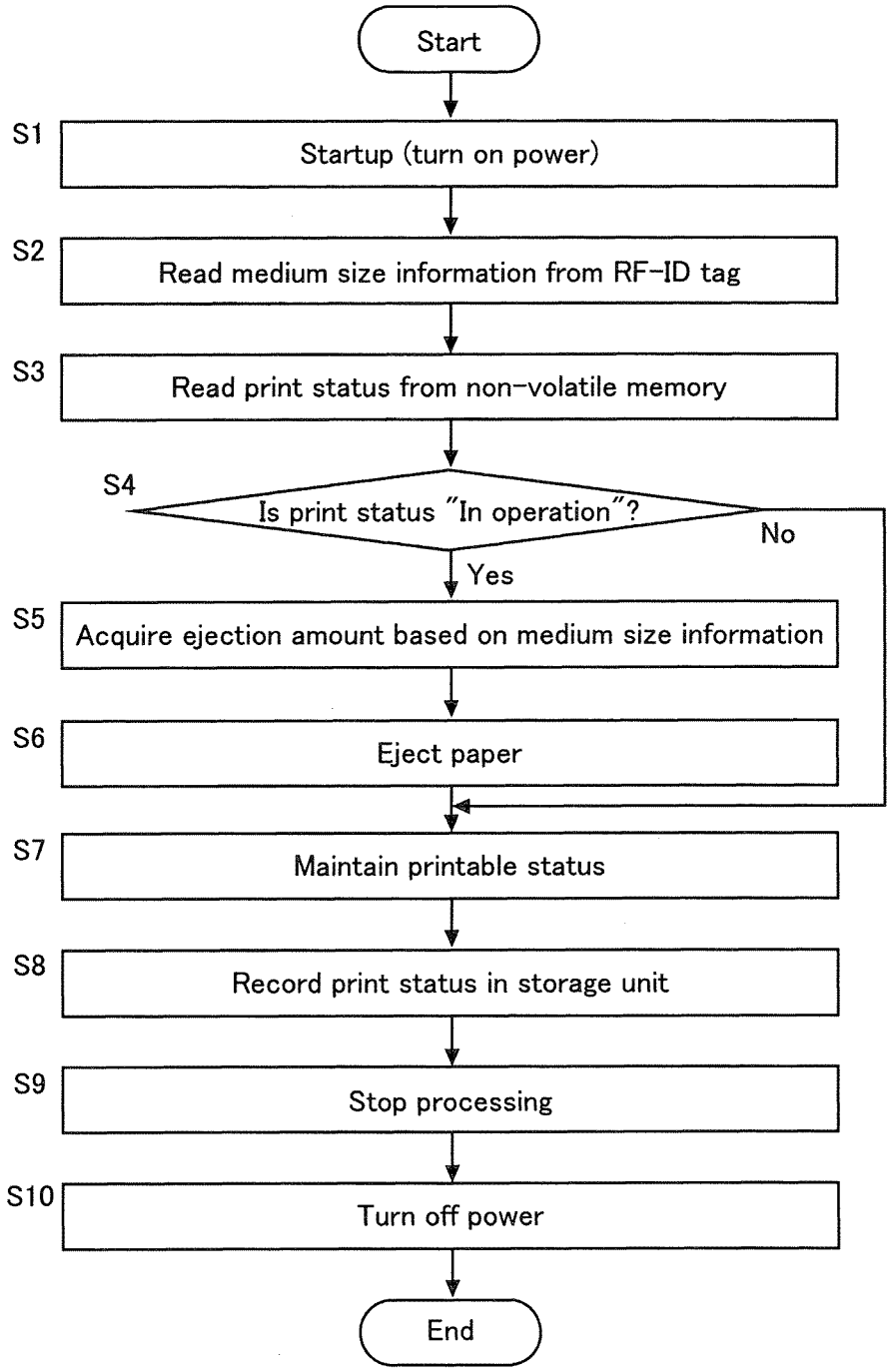
FIG. 3 is a flowchart showing how the printer of the present invention removes a halfway-printed recording paper.

The following describes how the printer of the present invention removes a halfway-printed recording paper with reference to the flowchart shown in FIG. 3, the timing diagrams shown in FIG. 4 and FIG. 5, the diagrams shown in FIG. 6 that show an example of the operation, and the diagrams shown in FIG. 7 that show the relation between the medium size information and the maximum print length.

To avoid an overlap between the print area of the previous printing and the print area of the current printing when the power is restored after the print operation is stopped with a halfway-printed print part on the recording paper, the following two must be performed: (a) Check whether or not the overlap in the print areas must be avoided and (b) Feed the paper for a required length to remove the previously-printed print if the overlap in the print areas must be avoided.

To do so, the printer of the present invention stores the print status in the print status storage unit 30*b*, checks the print status to determine if the print was halfway through when the print operation was stopped immediately before and, based on the determination result, confirms whether or not the overlap in the print areas must be avoided. This processing is performed by the rolled paper control unit 30C and the print status storage unit 30*b*.

If the determination described above indicates that the print operation was stopped with the print operation halfway through, the printer acquires the maximum print length that is set as print condition in the printer, feeds the rolled paper for the length corresponding to the acquired maximum print length, and cuts the paper to remove the halfway-printed recording paper. The printer automatically sets the length of the recording paper to be removed according to the size of the print area to be printed on the recording paper.

This processing is performed by the rolled paper control unit 30C, RF-ID reading unit 34, and medium size information—ejection amount storage unit 30*c*. The rolled paper control unit 30C acquires the medium size information read via the RF-ID reading unit 34, reads the ejection amount corresponding to the medium size information from the medium size information-ejection amount storage unit 30*c*, drives the rolled paper drive unit 32 to feed the rolled paper with the ejection amount as the maximum print length, and causes the cutting control unit 35 to cut the fed rolled paper.

The flowchart shown in FIG. 3 shows the operation from the time the printer power is turned on to the time the power is turned off. The print status before the power is turned on is assumed to be stored in the print status storage unit 30*b*. In the description below, assume that the print status stored in the print status storage unit 30*b* is, for example, "In operation" when printing is being performed and "Print terminated" when printing is terminated.

First, the following describes the operation in which the print status is stored in the print status storage unit 30*b* during the previous print operation. FIG. 4 shows that the power is turned off after the print processing is terminated during the previous print operation, and FIG. 5 shows that the power is turned off before the print processing is terminated during the previous print operation.

Figures 5A, 5B, 5C, 5D, 5E, 5F:
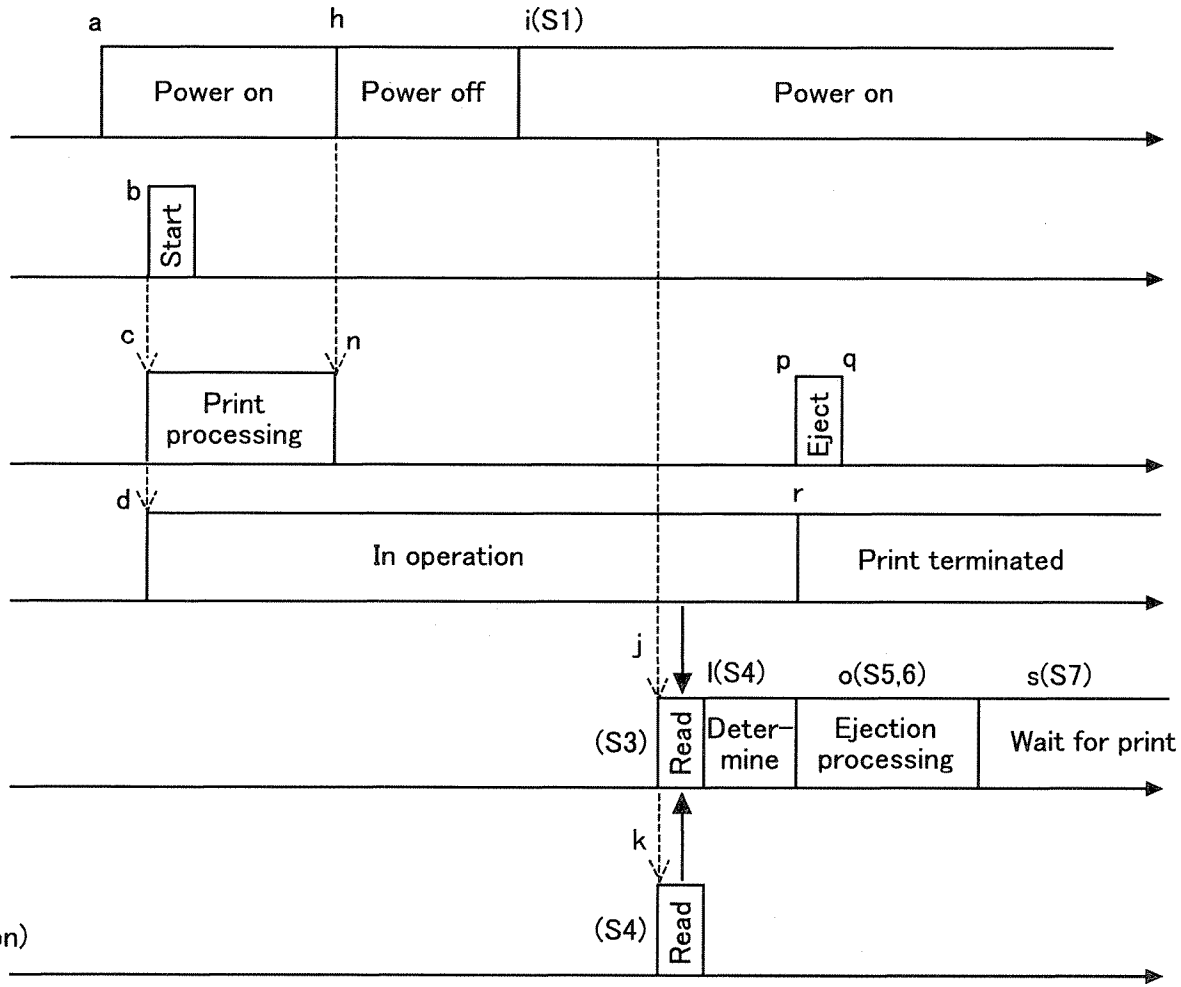
FIG. 5 is a timing diagram showing how the printer of the present invention removes a halfway-printed recording paper.

When the power is turned on ("a" in FIG. 4A, "a" in FIG. 5A) and a print start command is issued ("b" in FIG. 4B, "b" in FIG. 5B) in the timing diagrams in FIG. 4 and FIG. 5 showing an example of the operation, the print processing is started ("c" in FIG. 4C, "c" in FIG. 5C) and, at the same time, "In operation" is stored in the print status storage unit 30*b* ("d" in FIG. 4D, d in FIG. 5D).

When the print processing is terminated while the power is on in FIG. 4 ("e" in FIG. 4C), the ejection processing is performed immediately to eject the recording paper that has been printed ("f" in FIG. 4C), and "In operation" in the print status storage unit 30b is replaced by "Print terminated" ("g" in FIG. 4D).

In contrast, when the power is turned off during the print processing in FIG. 5 ("h" in FIG. 5A), the print processing is stopped halfway without ejecting the recording paper("n" in FIG. 5C). So, when the power is turned off during the print processing, "In operation" remains stored in the print status storage unit 30*b*.

As described above, when the print processing and the ejection are completed in the previous print processing, "Print terminated" is stored in the print status storage unit 30*b* as the print status ("a"-"g" in FIG. 4). In contrast, when the print processing and the ejection are not completed, "In operation" is stored in the print status storage unit 30*b* as the print status.

Next, the following describes the operation that is performed when the power is turned off during the previous printing ("h" in FIG. 4A, "h" in FIG. 5A) and, after that, the power is turned on again ("i" in FIG. 4A, "i" in FIG. 5A).

When a power SW 36 of the printer is turned on and the power is supplied, the control unit 30 starts the startup processing (S1). Although FIG. 2 does not include the configuration for the printer startup processing, this startup processing is the standard startup processing performed by the printer.

The rolled paper control unit 30C, started by the ON signal of the power SW 36 or a predetermined signal issued during the startup processing, reads the medium size information stored in an RF-ID tag (not shown) via the RF-ID reading unit 34 ("k" in FIG. 4F, "k" in FIG. 5F) (S2) and, at the same time, reads the print status stored in the print status storage unit 30*b* ("j" in FIG. 4E, "j" in FIG. 5E) (S3).

The rolled paper control unit 30C determines the print status at the previous operation termination time based on the print status that has been read. If the print status read from the print status storage unit 30*b* is "Print terminated", it is determined that the previous print was terminated normally and that a halfway-printed recording paper is not in the printer. On the other hand, if the print status read from the print status storage unit 30*b* is "In operation", it is determined that the previous print was not terminated normally and that a halfway-printed part is on the recording paper in the printer ("l" in FIG. 4E, "l" in FIG. 5E) (S4).

If the print status is "In operation" in the determination step in (S4), the recording paper containing a remaining print part must be ejected. To do so, the rolled paper control unit 30C calculates the maximum print length of this printing based on the medium size information that has been read, acquires the ejection amount of the recording paper (S5), and ejects the recording paper ("o" in FIG. 5E). Thus, the recording paper not ejected in the previous print operation but left in the printer is ejected ("p"-"q" in FIG. 5C) (S6), the rolled paper control unit 30C rewrites the contents of the print status storage unit 30*b* from "In operation" to "Print terminated" ("r" in FIG. 5E) (S8), and the printer enters the print wait status ("s" in FIG. 5E).

On the other hand, if the print status is "Print terminated" in the determination step in (S4), the ejection processing is not necessary because there is no recording paper containing a remaining print part.

After the determination processing ("l" in FIG. 4E), the rolled paper control unit 30C maintains the print wait status with "Print terminated" in the print status storage unit 30*b* ("m" in FIG. 4E) (S7).

FIG. 6 shows how the printer of the present invention ejects a recording paper, which contains a print part that was printed during the previous print operation, and prints on the recording paper.

Figure 6A:
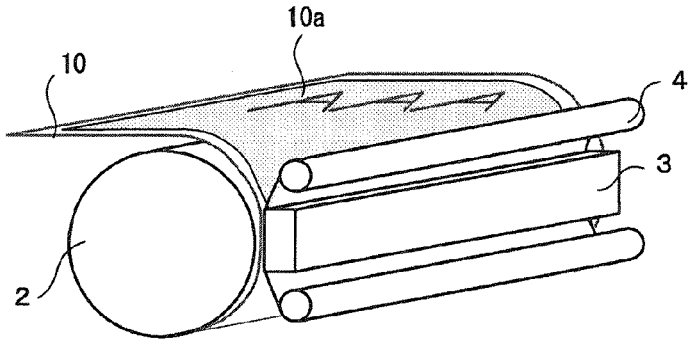
FIG. 6 is a diagram showing an example of the operation performed by the printer of the present invention to remove a halfway-printed recording paper.
Figure 6B:
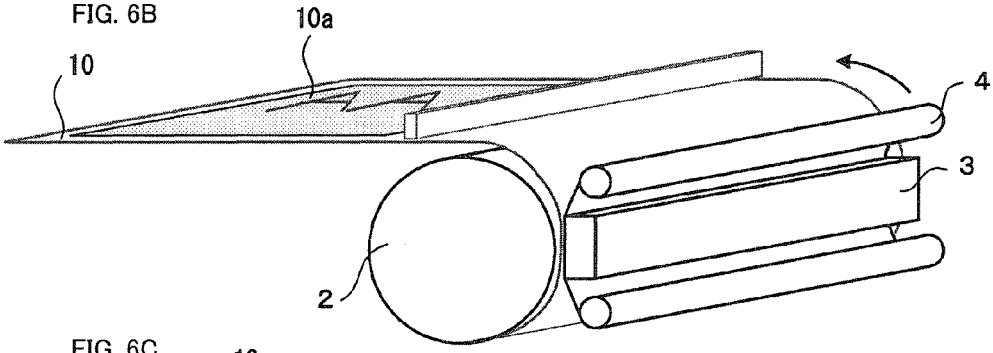
Figure 6C:
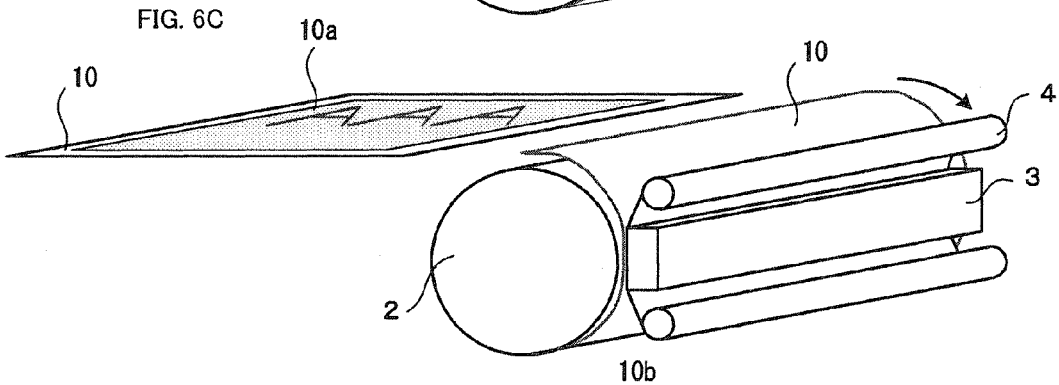
Figure 6D:
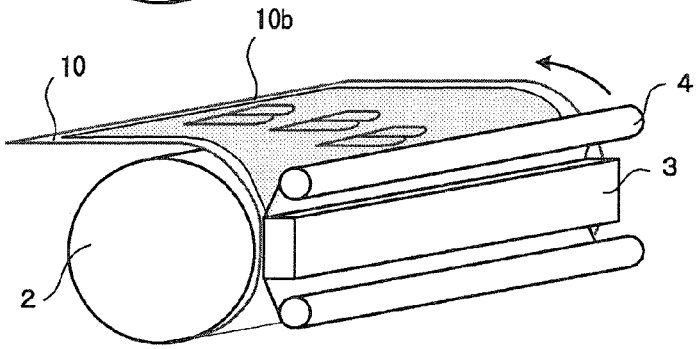

FIG. 6A shows the status in which printing stops halfway, and FIGS. 6B to 6D show the status after the power is turned on again. In FIG. 6, the recording paper 10 is rolled on the rolled paper holder 2, and the ink of the film-like ink ribbon stored in the ink ribbon cassette 4 is printed on the recording paper 10, unrolled from the rolled paper holder 2, by means of the head 3.

When the printer of the present invention is stopped halfway during printing due to a power failure, the recording paper 10 being printed is not ejected but is left in the printer with the previously-printed print area 10*a* printed on the recording surface of the recording paper 10 (FIG. 6A).

When the power is turned on again in the status described above, the recording paper 10 is ejected with the maximum print length, acquired based on the medium size information recorded in the RF-ID tag, as the ejection amount (FIG. 6B) and is cut by the recording paper cutting unit 5 (FIG. 6C). Cutting the recording paper 10 containing the printed part sets the recording paper, held on the rolled paper holder 2, to the initial status and, after that, the normal print processing is started (FIG. 6D).

Figure 7A:
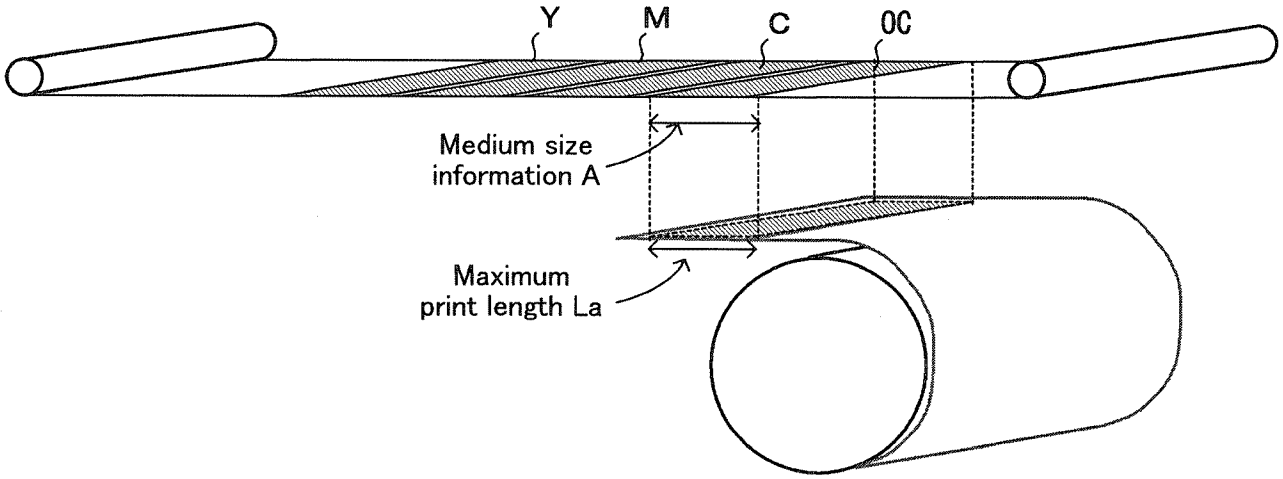
FIG. 7 is a diagram showing the relation between medium size information and the maximum print length.
Figure 7B:
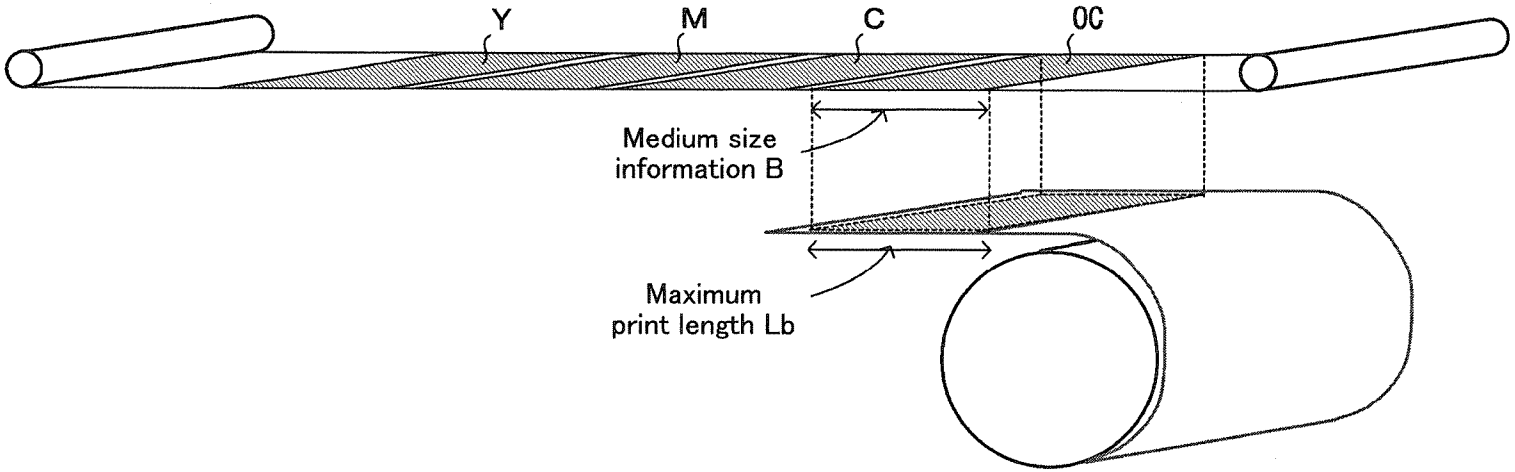
Figure 8A:
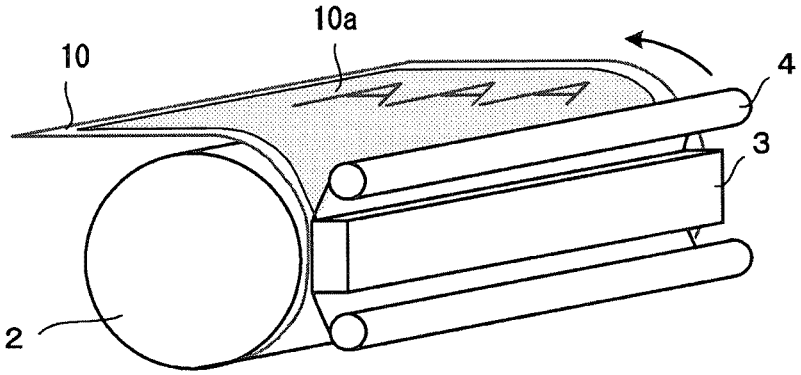
FIG. 8 is a diagram showing the print status of a conventional printer.
Figure 8B:
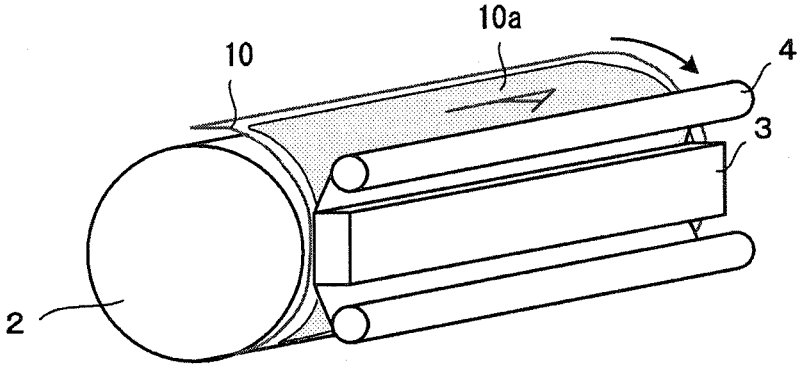
Figure 8C:
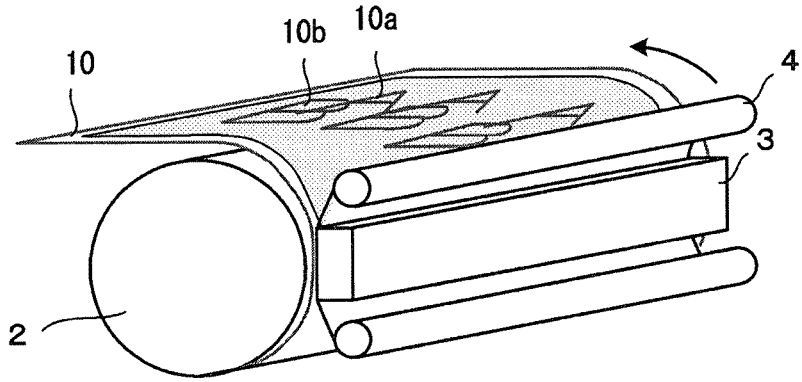

FIG. 7 shows the relation between the medium size information and the maximum print length. FIG. 7A shows the relation between the medium size information A and the maximum print length La, and FIG. 7B shows the relation between the medium size information B and the maximum print length Lb. Note that the size relation of the maximum print lengths La and Lb determined by the medium size information A and B which are shown in FIG. 7 do not show the actual ratios.

The ink ribbon used for printing has color parts (yellow(Y), magenta(M), and cyan(C)) and the overcoat layer(OC), and the whole print processing is terminated by coating the overcoat layer on the print surface on which all colors are printed. The color parts, that is, yellow(Y), magenta(M), and cyan(C), have almost the same length, and the overcoat layer(OC) is equal to or slightly longer than the length of each color part.

So, the length of a print area formed by one print processing operation is the maximum print length L that is the maximum of the lengths of yellow(Y), magenta(M), and cyan(C) color parts and the length of the overcoat layer(OC). Thus, the maximum print length depends on the length of a print area which, in turn, depends on the medium size such as the L-size, 2L-size, and 5A-size. In FIG. 7A, La is determined as the maximum print length corresponding to the medium size information A; in FIG. 7B, Lb is determined as the maximum print length corresponding to the medium size information B. The ejection amount is determined based on this maximum print length, and the printed recording paper is ejected and removed according to the length corresponding to this ejection amount to prevent overlapped printing.

The medium size information is recorded in a recording medium such as an RF-ID tag that is mounted on an ink ribbon cassette on which an ink ribbon is set. This RF-ID tag is read by the RF-ID reading unit, provided on the printer body, automatically at the same time the ink ribbon is exchanged and, from the medium size information, the ejection amount can be acquired.

Note that the configuration shown above is only exemplary, and the present invention is not limited to those examples but include various changes.

What is claimed is:

1. A printer that prints on a rolled recording paper using an ink ribbon, cuts the printed recording paper to a predetermined length, and ejects the cut recording paper wherein, in cutting and removing the recording paper before printing is restarted after the preceding printing is not completed, a length of the recording paper that is cut and removed is determined according to maximum of lengths of color parts of the ink ribbon and a length of an overcoat layer.

2. The printer according to claim 1 wherein the ink ribbon used for the printing is selectable from ink ribbons having different lengths and the maximum is a length required for one print operation in which a selected and mounted ink ribbon is used.

* * * * *